US005688375A

United States Patent [19]

Schiel

[11] Patent Number: 5,688,375

[45] Date of Patent: Nov. 18, 1997

[54] SHOE PRESS ROLL FOR A PAPER MACHINE

[75] Inventor: Christian Schiel, Heidenheim, Germany

[73] Assignee: Voith Sulzer Papiermaschinen GmbH, Germany

[21] Appl. No.: 628,278

[22] Filed: Apr. 5, 1996

[30] Foreign Application Priority Data

Apr. 29, 1995 [DE] Germany ..... 195 15 832.6

[51] Int. Cl.[6] ..... D21F 3/02; B30B 3/00

[52] U.S. Cl. ..... 162/358.3; 162/361; 162/358.5

[58] Field of Search ..... 162/358.3, 358.5, 162/361; 492/35, 2, 7, 4, 20

[56] References Cited

U.S. PATENT DOCUMENTS

| | | | |
|---|---|---|---|
| 4,776,069 | 10/1988 | Snellman | 492/16 |
| 4,858,292 | 8/1989 | Bühlmann et al. | 492/16 |
| 5,447,605 | 9/1995 | Roerig | 162/358.3 |
| 5,507,916 | 4/1996 | Schiel | 162/195 |

FOREIGN PATENT DOCUMENTS

| | | | |
|---|---|---|---|
| 2 199 398 | 7/1988 | United Kingdom | 162/358.3 |

*Primary Examiner*—Donald E. Czaja
*Assistant Examiner*—Jose A. Fortuna
*Attorney, Agent, or Firm*—Ostrolenk, Faber, Gerb & Soffen, LLP

[57] ABSTRACT

A shoe press roll for a paper machine which, together with a backing roll, forms a press nip through which a press jacket guided over the shoe press roll travels together with a paper web. The shoe press roll comprises a press shoe which can be pressed by at least one hydraulic element against the backing roll. The hydraulic element is developed as a cylinder/piston unit that acts between a stationary support member and the press shoe. The unit includes a first pressure chamber which can be acted on by hydraulic pressure and is in communication via a small diameter throttle point passing through the piston with a second pressure chamber which is open toward the press shoe. The edge of the piston rests with a sealing surface against the press shoe. Hydraulic pressure is transmitted from the first pressure chamber under approximately static conditions, to the second pressure chamber through the throttle point and thus to the press shoe. Should the press shoe tilt permitting pressure to escape from the second chamber at the shoe, the throttle point prevents rapid continuous flow of hydraulic pressure out of the first pressure chamber. The tilting produces a pressure drop in the second pressure chamber which causes the press shoe to apply itself against the cylinder/piston unit as a result of the external pressure applied from the first pressure chamber.

20 Claims, 2 Drawing Sheets

Fig. 2
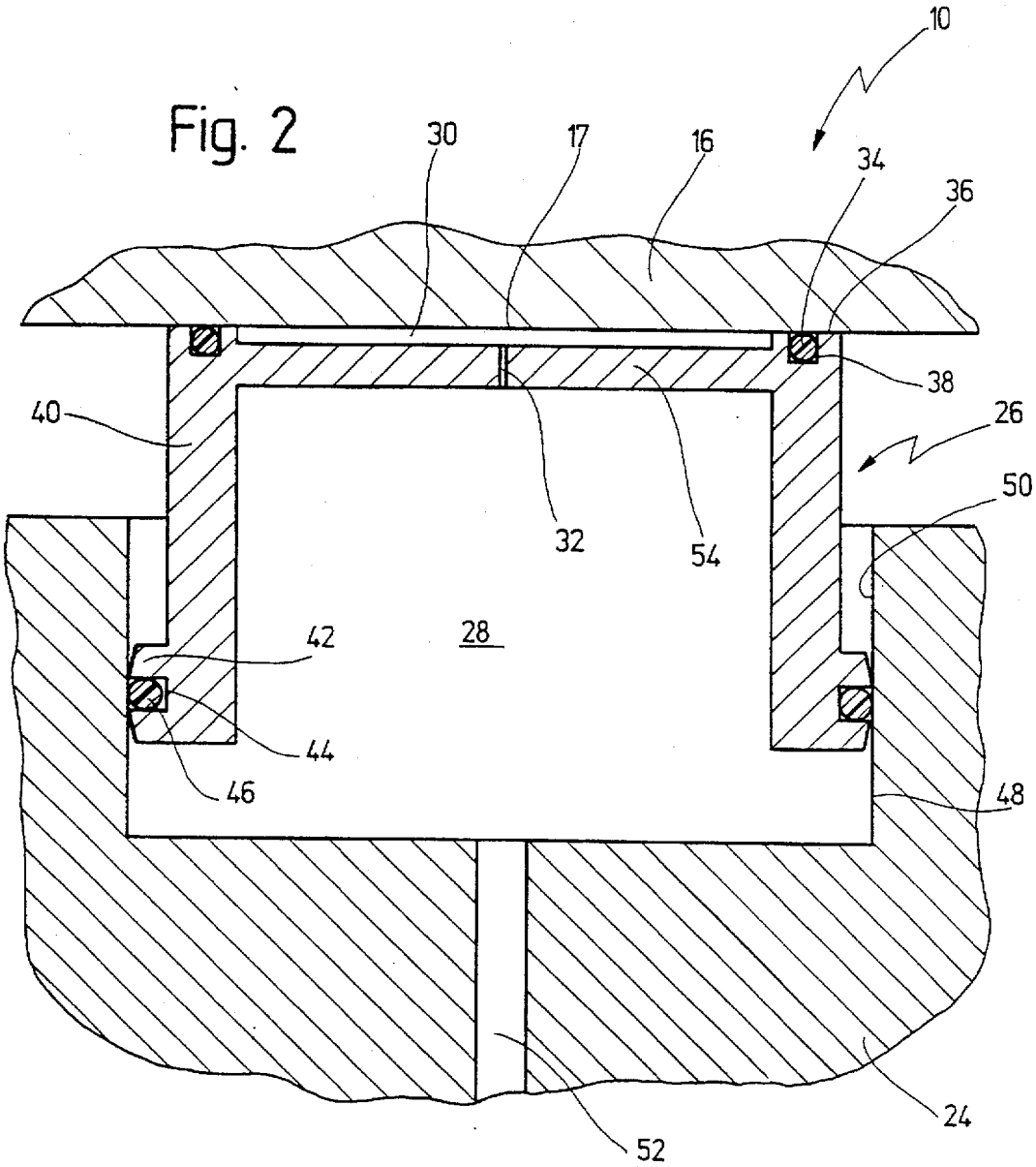
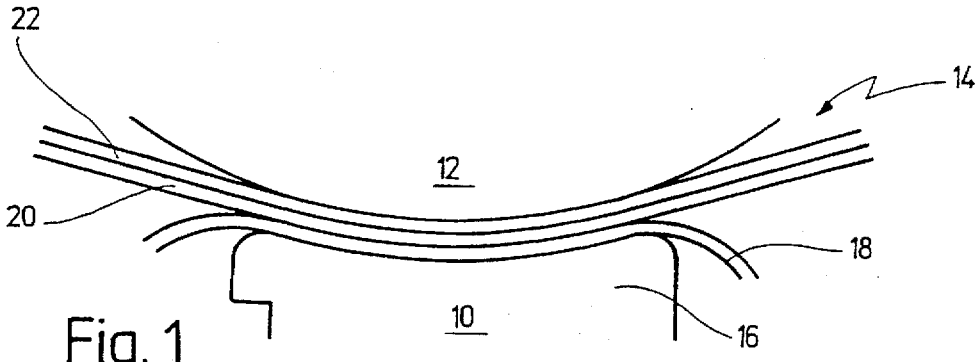
Fig. 1

SHOE PRESS ROLL FOR A PAPER MACHINE

BACKGROUND OF THE INVENTION

The invention relates to a shoe press roll for a paper machine. That "roll" comprises a stationary support that supports a press shoe which is urged toward a backing roll. The shoe press roll forms a press nip with a backing roll. A press jacket or press shell of a flexible material is conducted over the shoe press roll and travels together with a web of paper through the nip.

The shoe press roll comprises a press shoe which is pressed against the backing roll by at least one hydraulic element. The hydraulic element is developed as a cylinder/piston unit that acts between a stationary support member and the press shoe. That unit comprises a first chamber which can be acted on by hydraulic pressure and is in communication via a passage with a second pressure chamber which is open toward the press shoe and which rests at its edge with a sealing surface against the press shoe.

A shoe press roll of this type is known from Federal Republic of Germany Published Application 43 19 323 A1. The press shoe can be pressed by a hydraulic pressing unit against a backing roll. The hydraulic pressing unit extends essentially along the longitudinal direction of the press shoe. A plurality of hydraulic pressing or release units within the hydraulic pressing unit are arranged to permit adjustment of the pressing force along the length of the press shoe. The pressing or release units each comprise a hydraulic piston which is guided by a packing ring for axial displacement and which permit limited tilting of the piston in a cylindrical recess in the support member. The hydraulic piston rests via an annular sealing surface against the lower side of the press shoe. During operation, the press shoe may be tilted a certain amount with respect to the support member as a result of changes in length caused by heat or changes in load. A coil spring presses the piston against the bottom of the press shoe to prevent hydraulic fluid from emerging laterally from the hydraulic chamber between the sealing surface and the press shoe when the shoe tilts. The piston is secured against disengagement upon mounting by a chain which is attached to the support member. A bolt secures this chain to a continuous radial land on the piston, by which the pressure chamber is limited upwards in the direction towards the press shoe.

To assure complete transmission of the hydraulic pressure from the pressure chamber to the bottom of the press shoe and to prevent formation of an air cushion, a large hole is provided in the radial land. This causes the second pressure chamber, which is open toward the press shoe and is formed above the first pressure chamber, to communicate freely with the first pressure chamber, whereby hydraulic pressure is transmitted directly to the bottom of the press shoe. Pressure leakage from either pressure chamber immediately correspondingly reduces the pressure in the other pressure chamber.

The relatively complicated construction and relatively complicated mounting resulting from the coil spring and the securing chain have proven disadvantageous.

SUMMARY OF THE INVENTION

The object of the present invention is to improve such a shoe press roll that construction and mounting can be effected in the simplest and most economical manner.

According to the invention, the passage between the two pressure chambers is developed as a narrowed throttle point.

This achieves an object of the invention by making it possible to dispense with the installation of the above described coil spring and a corresponding securing element. The throttle point can be dimensioned so that substantially the same pressure prevails in the two pressure chambers when the press shoe is resting against the sealing surface. In normal operation, when the piston rests with its sealing surface directly against the press shoe, the hydraulic pressure is completely transmitted to the press shoe. However, should the press shoe tilt somewhat upon operation, hydraulic oil can emerge laterally from the second pressure chamber between the press shoe and the sealing surface. As a result of the throttling action in the passage, further flow of hydraulic fluid out of the first chamber is, however, greatly limited, so that when the pressure in the second pressure chamber immediately drops greatly, only small amounts of hydraulic liquid can emerge laterally between the press shoe and the sealing surface. Thus, the pressure in the second pressure chamber on the other side of the throttle passage decreases so that the press shoe again applies itself against the sealing surface of the second pressure chamber due to the higher pressure on this side of the throttle passage.

It is known in principle, for so called sag adjustment rolls that are operated in accordance with the principle of the hydraulic bearing, to supply pressure to pressure pockets for supporting a rotating, hydrostatically supported, metal jacket via throttle points. But the present invention is an improvement upon this since an entirely different purpose is concerned here, namely instead of providing a positioning aid for use solely upon starting up, providing a continuous supply of lubricating oil to a hydrostatic lubricating slot is the goal, in addition to adjusting the sag curve by an adaptation of the pressure.

In accordance with the invention, on the other hand, a throttle point is provided for hydraulically supporting the press shoe. The flow through the throttle point is practically zero upon operation.

In a further self evident development of the invention, one or more packing rings can be inserted in the sealing surface of the piston at the press shoe in order to seal off from the press shoe.

In principle, it is possible to arrange a cylinder of the cylinder/piston unit between the press shoe and the support member and to provide the associated piston in the support member.

However, in the invention, it is preferred for the cylinder/piston unit to comprise a recess in the support member within which a piston is guided in an axially displaceable and tiltable manner by means of a packing. This provides a particularly simple construction.

The self regulating application of the press shoe against the cylinder/piston unit makes it possible with the invention to dispense with additional pressing elements, such as coil springs and the like, so that the invention enables greatly simplified erection and mounting.

As another feature of the invention, the first pressure chamber below the piston is closed off from the second pressure chamber above the piston by a loose disk. Under the action of the hydraulic pressure in the first pressure chamber, the disk rests against a supporting projection on the piston. The disk is developed similarly to a valve plate. In case of a sudden reduction of pressure in the first pressure chamber beneath the piston, the disk can lift off from the projection on the piston. The projection is preferably developed as an annular land, so that any compressed air can escape from the upper pressure chamber via the large relief cross section at the circumference of the disk.

The above mentioned and other features of the invention can be used not only in the combinations indicated, but also by themselves or in other combinations within the invention.

Other objects, features and advantages of the invention are apparent from the following description of a preferred embodiment, read with reference to the drawings.

BRIEF DESCRIPTION OF THE DRAWINGS

FIG. 1 is a schematic side view of a press nip of a shoe press;

FIG. 2 is an enlarged cross section through a fragment of a shoe press roll of the invention in the region of the press shoe and of a cylinder/piston unit;

DESCRIPTION OF PREFERRED EMBODIMENTS

Figure 3:
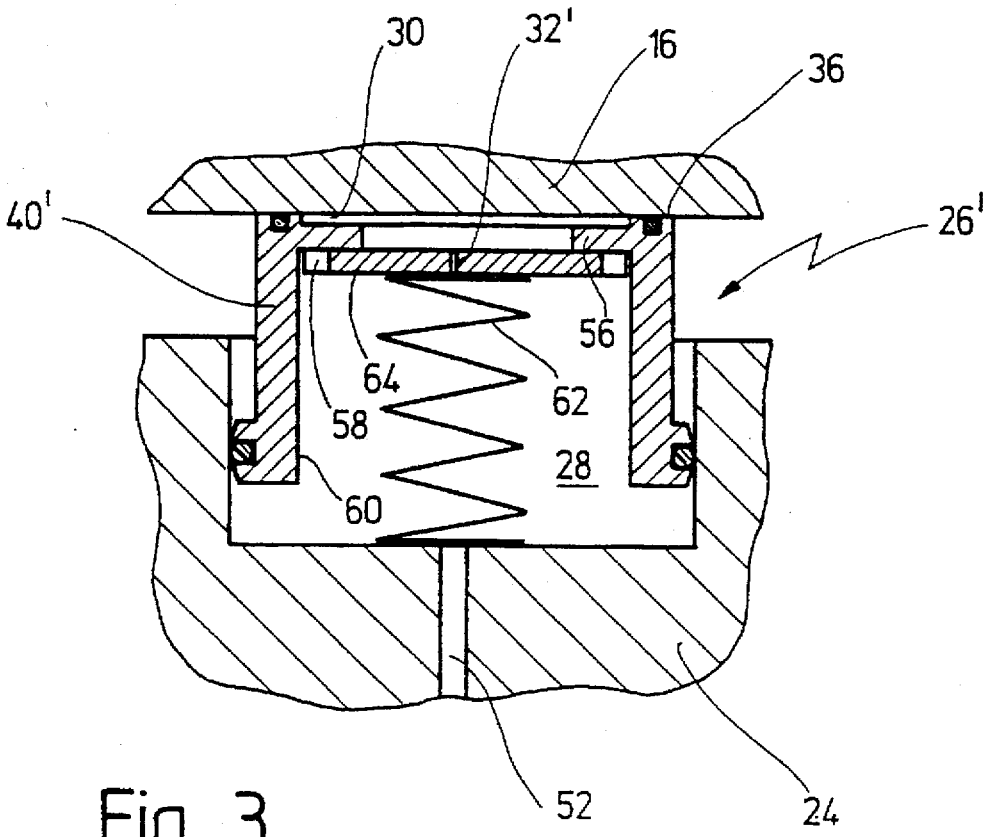
FIG. 3 is a fragment of a modified embodiment of the invention as compared with FIG. 2.

FIG. 1 diagrammatically shows a shoe press in the region of the press nip 14. There is a shoe press roll below and a backing roll 12 above the shoe press roll which is associated with the shoe press roll to define a press nip 14. A flexible press jacket 18 is conducted in known manner through the press nip 14 over the press shoe 16. The jacket 18 slides on a hydrodynamic lubricating wedge substantially free of friction over the press shoe 16. A paper web 22 from which the water is to be removed is conducted together with at least one felt belt 20 through the press nip 14.

As shown in FIG. 2, the press shoe 16 can be pressed up by a plurality of hydraulic elements against the backing roll 12. Those elements rest on a stationary support member 24 below the shoe. Each hydraulic element comprises a cylinder/piston unit 26 comprising a cylindrical recess 48 in the support member 24 and a piston 40 which is guided for radially directed motion in the recess.

On its lower end facing into the cylindrical recess 48, the piston 40 has an outer collar 42. An annular groove 44 in the periphery of the collar receives a packing 46 in the form of a packing ring. The piston 40 is guided of the press roll which is in axially of the piston and also tiltable in orientation to a certain extent, by the packing ring 46 resting on the inner surface of the cylindrical recess 48.

At its radially outward end facing the press shoe, the piston 40 includes an annular sealing surface 36 that rests against a flat radially inward resting surface 17 of the press shoe 16. An annular groove 38 is defined radially outward of the piston within the annular sealing surface 36, and a packing ring 34 is held in the groove 38.

The piston 40, the cylindrical recess 48, and the press shoe 16 are shaped so as together to form two pressure chambers, namely a first pressure chamber 28 between the cylindrical recess 48 and the piston 40 and a second pressure chamber 30 between the piston 40 and the press shoe 16. The chambers 28 and 30 are separated by a radial land 54 in the form of a disk which forms a piston head as it is the top end of a piston.

A small diameter throttle opening or throttle point 32 extends through the radial land 54 and that opening defines a connection between the first pressure chamber 28 and the second pressure chamber 30. The diameter of the throttle point 32 is such that, under practically static conditions, when the flat resting surface 17 of the piston 16 rests completely or flat against the sealing surface 36 of the piston 40, the same pressure prevails in the second pressure chamber 30 and in the first pressure chamber 28. The hydraulic pressure transmitted into the first pressure chamber 28 via a hydraulic channel 52 through the support 24 and is transmitted directly via the second pressure chamber 30 to the press shoe 16. If only one throttle point 32 is present, then its diameter is at most about 5 mm, and preferably about 1 to 4 mm. If several such throttle points are used, their respective diameters are correspondingly less.

Should the press shoe 16 tilt with respect to the piston 40 during operation, hydraulic oil can emerge laterally from the second pressure chamber 30 through the slot that then forms between the resting surface 17 of the press shoe 16 and the sealing surface 36 of the piston 40. However, the small diameter of the throttle point 32 prevents a rapid flow of hydraulic oil out of the first pressure chamber 28 into the second chamber 30. This produces a strong pressure drop in the second pressure chamber 30 which causes the press shoe 16 to again rest against the piston 40 as a result of the counter pressure exerted by the backing roll. This again closes off the second pressure chamber 30 permitting hydraulic pressure corresponding to the level of hydraulic pressure in the first pressure chamber 28 to again build up in the second pressure chamber 30.

Figure 4:
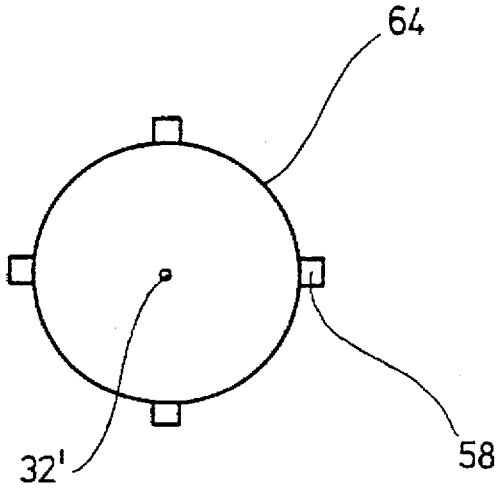
FIG. 4 is a plan view of the disk shown in FIG. 3.

An alternative embodiment of the invention is shown in FIGS. 3 and 4. The same reference numerals are used herein for identical parts.

The modified piston 40' is closed off on its radially outward top, not by an integrated piston head, but by a loose disk 64 through which the central throttle point or opening 32' passes. This disk 64 is developed in a manner similar to a valve plate. It is pressed by the pressure in the first pressure chamber against an annular land or support 56 at the top of the piston 40'. As seen in FIG. 4, the disk 64 has four outer projections 58 spaced at uniform angular distances apart of 90°. These projections center the disk on the inner surface 60 of the piston 40'. Upon a sudden relief of pressure in the first chamber 28 below the disk, the disk 64 can lift off from the annular land 56 and compressed air present possibly laterally in the pressure chamber 30 can be rapidly be reduced in pressure via the enlarged relief cross section around the periphery of the downwardly shifted disk 64.

FIG. 3 shows a spring 62 which presses the piston 40' against the press shoe 16. Such a spring can be additionally provided in FIG. 1 or FIG. 3 if complete tightness of the cylinder/piston unit is desired also upon starting. However, the spring 62 is substantially weaker than with traditional hydraulic elements, since the spring transmits preferably less than about 20% of the pressing force to the press shoe 16.

Instead of a single throttle point 32', several correspondingly dimensioned throttle points can, of course, alternatively be provided.

There might also be an insert in the support 24 in which the cylindrical recess 48 can be formed. The piston is guided by its packing in that recess. Furthermore, the recess 48 need not be cylindrical but may alternatively have a rectangular or other cross section and the piston 40 would be of corresponding cross-section.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A shoe press roll for a paper machine, wherein the shoe press roll cooperates with a backing roll to form a press nip through which pass a press jacket on which a web to be dewatered is supported as they travel together through the press nip when the backing roll rotates through the press nip and the press jacket moves through the press nip, the shoe press roll comprising:

a stationary support with a cylinder defined therein opening radially outward toward the press nip and the backing roll;

a press shoe located toward the radial outside of the cylinder, the shoe having an outward surface toward the backing roll which defines the press nip with the backing roll and having an inward surface facing toward the cylinder;

a piston located in the cylinder, the piston having first and second sides below and above the piston, respectively, and the piston being sealingly movable along the cylinder toward and away from the backing roll;

a first pressure chamber in the cylinder below the first side of the piston away from the press shoe, and means for communicating hydraulic pressure to the first pressure chamber;

the piston being shaped for defining a second pressure chamber above the second side of the piston toward the press shoe, the piston second side and the press shoe inward surface being normally cooperatingly shaped for sealing the second pressure chamber; and a passage from the first pressure chamber to the second pressure chamber, the passage having a cross section sized for defining a throttle point for permitting throttled passage of hydraulic pressure from the first pressure chamber to the second pressure chamber, the passage having a cross section for preventing a rapid reduction of pressure in the first pressure chamber, occurring by a sudden reduction of pressure in the second pressure chamber, thereby permitting continued urging of the piston toward its sealing position against the press shoe for sealing the second pressure chamber.

2. The shoe press roll of claim 1, wherein the piston is shaped to define a sealing periphery around the second pressure chamber at the inward surface of the press shoe, and the piston having an edge around the sealing periphery which seals against the inward surface of the press shoe for sealing the second pressure chamber.

3. The shoe press roll of claim 2, wherein the sealing periphery around the second chamber includes a packing ring for sealing off the piston against the press shoe.

4. The shoe press roll of claim 1, wherein the passage from the first chamber into the second chamber passes through the area of the piston defining the second chamber.

5. The shoe press roll of claim 1, wherein the throttle point passage is dimensioned so that with the piston sealed against the inward side of the press shoe sealing the second chamber, substantially the same hydraulic pressure is present in both of the first and second pressure chambers.

6. The shoe press roll of claim 1, wherein the piston is so shaped in the cylinder that it can assume a first tilt orientation wherein the piston seals to the inward surface of the press shoe or is otherwise tilted with respect to the press shoe so as to not seal to the inward surface of the press shoe and permit leakage of hydraulic pressure from the second pressure chamber.

7. The shoe press roll of claim 6, wherein the throttle point passage is dimensioned so that with the piston sealed against the inward side of the press shoe sealing the second chamber, substantially the same hydraulic pressure is present in both of the first and second pressure chambers; and when the press shoe and the piston are tilted with respect to each other which opens the seal between the press shoe and the piston, the pressure in the second chamber drops while the pressure in the first pressure chamber remains elevated enabling the pressure in the first pressure chamber to support setting of the press shoe against the piston to reestablish the seal of the second pressure chamber, and the dimension of the throttle point is sized so as to minimize emergence of hydraulic pressure between the piston and the press shoe when the press shoe and the piston are tilted with respect to each other.

8. The shoe press roll of claim 6, wherein the piston is shaped in the cylinder in the support for being guided for radial displacement with respect to the support; and the piston being supported to tilt in the recess with respect to the cylinder.

9. The shoe press roll of claim 8, further comprising a packing on the piston for maintaining the seal of the piston in the cylinder when the piston tilts.

10. The shoe press roll of claim 9, wherein the cylinder in the support has an interior surface and the packing on the piston comprises an annular packing ring on the piston which is in contact with and is guided on the interior surface of the cylinder.

11. The shoe press roll of claim 1, wherein the throttle point opening has a diameter of at most 5 mm.

12. The shoe press roll of claim 1, wherein the piston includes a disk movable in the cylinder apart from the piston and means on the disk and the piston for the disk to rest against the piston and provide a seal between the first and the second pressure chambers across the piston; the disk being so placed that the hydraulic pressure in the first pressure chamber presses the disk to cooperate with and seal against the piston, separating the first and second pressure chambers.

13. The shoe press roll of claim 12, wherein the disk is so supported with respect to the piston that upon a relative reduction of-pressure in the first pressure chamber with reference to the pressure in the second pressure chamber, the disk moves off the sealing position with reference to the piston thereby opening communication past the disk between the first and the second pressure chambers.

14. The shoe press roll of claim 13, wherein the throttle point passage passes through the disk.

15. The shoe press roll of claim 13, further comprising a spring acting on the disk and normally urging the disk to its position sealing against the piston, the spring permitting the disk to move off its position sealing against the piston.

16. The shoe press roll of claim 1, wherein the means for communicating hydraulic pressure to the first pressure chamber includes a further passage of greater cross section than the passage from the first pressure chamber to the second pressure chamber.

17. A shoe press roll for a paper machine, wherein the shoe press roll cooperates with a backing roll to form a press nip through which pass a press jacket on which a web to be dewatered are supported as they travel together through the press nip when the backing roll rotates through the press nip and the press jacket moves through the press nip, the shoe press roll comprising:

a press shoe for being urged toward the backing roll;

a stationary support member;

a hydraulic element developed as a cylinder/piston unit located between the stationary support member and the press shoe, the cylinder/piston unit comprising:

a first pressure chamber, and means for delivering hydraulic pressure to the first pressure chamber;

a second pressure chamber which is open toward the press shoe and edge means defining an edge around the second pressure chamber, the edge means resting sealingly against the press shoe;

a passage having a cross section sized for defining a hydraulic pressure throttle point communicating between the first and second pressure chambers, and the passage being sized so that a reduction in the pressure in the second pressure chamber with reference to the pressure in the first pressure chamber does not cause an immediate reduction in the pressure in the first pressure chamber.

18. The shoe press roll of claim 17, wherein the press shoe has a position resting against the edge means surface of the cylinder/piston unit, and the throttle point being so dimensioned that substantially the same pressure prevails in both the first and second pressure chambers, and such that when the press shoe is tilted with respect to the sealing surface of the cylinder piston unit and causing the pressure in the second pressure chamber to drop, the throttle point maintains the pressure in the first pressure chamber so as to support setting back of the press shoe against the edge means and to minimize the emergence of hydraulic pressure between the edge means and the press shoe.

19. The shoe press roll of claim 18, wherein the throttle point has a diameter of at most 5 mm.

20. The shoe press roll of claim 19, wherein the means for communicating hydraulic pressure to the first pressure chamber includes a further passage of greater cross section than the passage from the first pressure chamber to the second pressure chamber.

* * * * *